US008752864B2

(12) United States Patent
Estrugo Mari

(10) Patent No.: US 8,752,864 B2
(45) Date of Patent: Jun. 17, 2014

(54) SKI TRANSPORTATION DEVICE

(75) Inventor: Sabina Francisca Estrugo Mari, Gandia (ES)

(73) Assignees: Sabina Francisca Estrugo Mari, Gandia (Valencia) (ES); Antonio Jose Peiro Rosello, Gandia (Valencia) (ES)

( * ) Notice: Subject to any disclaimer, the term of this patent is extended or adjusted under 35 U.S.C. 154(b) by 0 days.

(21) Appl. No.: 13/641,893

(22) PCT Filed: Feb. 25, 2011

(86) PCT No.: PCT/ES2011/070123

§ 371 (c)(1),
(2), (4) Date: Oct. 18, 2012

(87) PCT Pub. No.: WO2011/131810

PCT Pub. Date: Oct. 27, 2011

(65) Prior Publication Data

US 2013/0033030 A1 Feb. 7, 2013

(30) Foreign Application Priority Data

Apr. 19, 2010 (ES) ..... 201030565

(51) Int. Cl.
*A63C 11/02* (2006.01)

(52) U.S. Cl.
USPC ..... 280/814; 280/809; 280/815; 224/917

(58) Field of Classification Search
USPC ..... 280/809, 814, 815; 224/917
See application file for complete search history.

(56) References Cited

U.S. PATENT DOCUMENTS

| | | | | | |
|---|---|---|---|---|---|
| 2,999,378 | A | * | 9/1961 | Blair | 280/814 |
| 3,091,011 | A | * | 5/1963 | Campbell | 280/814 |
| 3,275,160 | A | * | 9/1966 | Zurker | 211/70.5 |
| 3,504,405 | A | * | 4/1970 | Elliott-Smith | 70/58 |
| 3,962,893 | A | * | 6/1976 | Anderson | 70/19 |
| 4,134,182 | A | * | 1/1979 | Ramsby | 280/814 |
| 4,175,683 | A | * | 11/1979 | Shields | 280/814 |
| RE30,523 | E | * | 2/1981 | Rich | 70/58 |
| 4,681,246 | A | * | 7/1987 | Andersson | 224/267 |
| 4,699,415 | A | * | 10/1987 | Skovajsa | 294/147 |
| 4,871,102 | A | * | 10/1989 | Wickersham | 224/191 |
| D310,909 | S | * | 10/1990 | Bradtl | D3/259 |
| 5,639,122 | A | * | 6/1997 | Churchill | 280/814 |
| 5,713,587 | A | * | 2/1998 | Morrow et al. | 280/14.21 |
| 5,971,420 | A | * | 10/1999 | Okajima et al. | 280/613 |

(Continued)

FOREIGN PATENT DOCUMENTS

| | | |
|---|---|---|
| CH | 697 721 | 1/2009 |
| ES | 1 106 370 | 11/1991 |
| ES | 2 343 827 | 8/2010 |
| WO | 2006/128844 | 12/2006 |

*Primary Examiner* — J. Allen Shriver, II
*Assistant Examiner* — Travis Coolman
(74) *Attorney, Agent, or Firm* — Michael J. Striker

(57) ABSTRACT

In principle, the device comprises a supporting element for a ski that is placed beside the outer side of a ski boot, the supporting element having a movable part formed by a rotatable body and a fixed part on which the movable part is coupled rotatingly, while the rotatable body includes a receptacle for receiving the rear end section of the ski. It is characterized in that the receptacle of the rotatable body is delimited by an elastic frontal retaining and support rim (7) for the ski and adjustable runners (8) that can be adapted to the width of the ski (6).

13 Claims, 6 Drawing Sheets

(56) References Cited

U.S. PATENT DOCUMENTS

| | | | | |
|---|---|---|---|---|
| 6,070,906 | A * | 6/2000 | Allen | 280/814 |
| 6,247,728 | B1 * | 6/2001 | Verville | 280/811 |
| 6,705,634 | B2 * | 3/2004 | Anderson et al. | 280/627 |
| 2007/0210570 | A1 * | 9/2007 | Erichsen | 280/814 |
| 2008/0023956 | A1 * | 1/2008 | Fischli | 280/809 |
| 2008/0098625 | A1 | 5/2008 | Salvatore | |

* cited by examiner

SKI TRANSPORTATION DEVICE

CROSS-REFERENCE

The invention described and claimed hereinbelow is also described in PCT/EP2011/070123, filed on Feb. 25, 2011 and P201030565, filed on Apr. 19, 2010. This Spanish Patent Application, whose subject matter is incorporated here by reference, provides the basis for a claim of priority of invention under 35 U.S.C. 119 (*a*)-(*d*).

BACKGROUND OF THE INVENTION

The present invention, as stated in the heading of this description, relates to Improvements made to Invention Patent number P20080256018 by: SKI TRANSPORTATION DEVICE.

The device is conceived for ski users to occasionally carry the skis during routes made on foot, without having to manually bear and withstand the weight of the skis themselves.

The device of the invention aims to liberate the user from the weight of the skis during trajectories made on foot, in such a way that the rear end of the skis is supported and retained in a supporting element placed on the outer side of the ski boots.

Based on this premise, the object of the invention is improvements focused precisely on the supporting element itself which presents a new structure, notably means of adjustment to adapt to the width of the skis with a view to achieving better support thereof.

Other improvements focus on new means for securing the supporting element to each one of the ski boots when said supporting element is secured to the ski boots in a detachable manner.

Currently, when skiers move on foot they have to carry their skis by holding them against their body, normally in a vertical position or also in a horizontal position by resting them against on one of their shoulders, this method of transporting the skis being fairly uncomfortable.

At the same time, Invention Patent number 200802560 is also known, describing a ski transportation device which basically comprises a supporting element placed on the outer side of a ski boot, in such a way that said supporting element has a receptacle in which the rear end sections of the skis corresponding to the tails are supported and retained, making it much more comfortable for the user to carry the skis by holding them simultaneously from their top part with their hands.

This device presents the drawback of the receptacle that supports the skis by their rear ends not being adjustable to the width of the skis, meaning that there is a looseness that hinders and obstructs normal walking by the user.

Invention Patent US-2008/0098625 incorporates a non-rotating receptacle joined to a laminar body that is secured to the boots.

Invention Patent U.S. Pat. No. 4,681,246 basically describes the same thing as the previous US patent, with the difference that the receptacle is secured to the boot by means of a sort of belt.

Invention Patent WO 2006/128844 is also known, which describes a pocket-type receptacle that is secured to the leg of the skiing boot by means of a strap with adherent surfaces that ensure its fastening to the mouth.

SUMMARY OF THE INVENTION

With a view to achieving the objectives and avoiding the drawbacks mentioned in the preceding paragraphs, the invention proposes improvements made to Invention Patent number 200802560/8 by: SKI TRANSPORTATION DEVICE.

The improvements comprise a characteristic supporting element placed on the outer side of skiing boots, the supporting element incorporating a receptacle for accommodating the rear end sections of the skis with means of adjustment to adapt to the width of the skis, at the same time as these rest by their free rear edge against the bottom of the receptacle of the supporting element.

As in the case of the main Invention Patent, the supporting element comprises in principle a movable part formed by a rotatable body and a fixed part determined by a ring base on which the movable part of the aforesaid supporting element can freely rotate, the movable part having a receptacle that receives the rear end section of the skis, in such a way that said rotation substantially facilitates walking by the user when carrying the skis held by their tails in the supporting elements of the boots and additionally held with the hands from the top half of said skis.

Therefore, the receptacle of the supporting element can be adapted to the different ski widths existing on the market, having to this effect a pair of adjustable runners for adapting to the width of the skis no greater than required for appropriate securing.

At the same time, the movable part of the supporting element incorporates a frontal elastic rim that ensures that the ski is sufficiently held and pressed against the supporting element to prevent it from coming out of the receptacle delimited basically by the elastic rim and the adjustable runners, but also granting the necessary mobility so that when walking the ski can move in all necessary angles to guarantee functionality and comfort when walking. Said frontal fastening has an outwards curvature in its bottom part necessary for accommodating the end shape of the ski tails, in such a way that the fit is perfect, and guarantees the necessary mobility for walking without the skis hitting against the user's knees or any other incident. In the rear part of the supporting element a ring base of soft material has been incorporated to ensure suitable contact of the supporting element with the multiple shapes of the sides of the boots, ensuring the fit or contact, and in turn guaranteeing that the supporting element does not move involuntarily in respect of the boot. The rotating system of the supporting element on its own axis is also an interesting technical solution to be considered. The solution ensures that the ski is introduced and removed safely and easily, preventing it from coming out involuntarily.

The rigid laminar body of the main Invention Patent has been replaced with a strap that adjusts to the boot in three directions. This strap ensures that the supporting element can be secured to any shape of boot, since a rigid laminar body would be impossible to fit onto the infinite variations of boots existing on the market. By anchoring the strap in three directions, total fastening of the supporting element is ensured, at the same time as it suitably withstands the weight of the ski and its movement when walking. The strap adheres to itself at the end part using adherent surfaces incorporated thereto.

Therefore it consists of a single strap which folds over itself to travel in the three aforesaid directions to ensure that the strap does not move and that once the strap is adjusted for first use, no subsequent adjustments need to be made to find its exact position according to the needs of the complete boot. The solution of the strap over the laminar body additionally provides certain flexibility to adjust the skis to the natural movement when walking, and avoids rigidities caused, for example, when any part of the ski collides against limbs of the body.

The solutions described allow the device of the invention not to have to be removed for skiing, since it does not encounter the snow when bending, nor does the laminar body initially contemplated in the main Invention Patent have to be removed when putting the boot on or taking it off.

There is also the possibility of fixing the assembly of the supporting element to the ski boot by the ring base constituting the fixed part, in this case dispensing with the strap.

Thus, securing of the supporting element is resolved with the use of the strap of soft material which can be made of fabric and polyester, adjustable by means of an adherent surface, the strap embracing the boot in three zones ensuring that the device of the invention is centered and correctly secured to the aforesaid boot, in such a way that in the zone of contact between the device and the boot a ring is inserted of soft material such as neoprene foam, which acts as an anti-slip element adapting the flat profile of the device to the boot's irregular contour.

Through the characteristic rotatable body the latter can be adjusted to different ski widths. The ski's entry in the device is facilitated by a mouth in the form of a funnel, in such a way that the very geometry and flexibility of the material used by the rotatable body allows good entry and at the same time assures a self-adjustable fastening that prevents the accidental exit of the ski.

On a separate note, it is also worth noting that the characteristic structure presented by the rotatable body ensures adaptation to the curvature of the ski tail, allowing at the same time a certain sideways rotation (in the right/left direction). This combination of movements of rotation acts as a pivot, facilitating and accompanying in a controlled and safe manner the natural movement of the user when walking, in contrast with what one might find if there was excessive rigidity or lack of fastening at that point transmitting insecurity or not very fluid motion.

Next, to facilitate a better understanding of this description and forming an integral part thereof, a set of drawings is attached which by way of illustration and not limitation represent the object of the invention.

DESCRIPTION OF A PREFERRED EMBODIMENT

Figure 1:
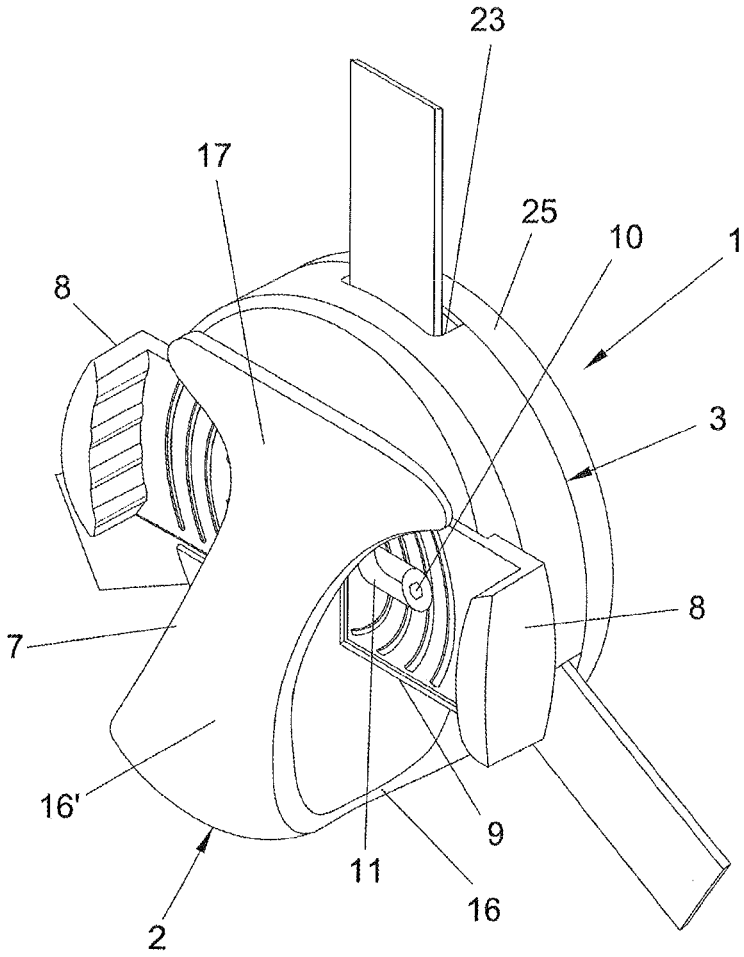
FIG. 1 shows a perspective view of a ski transportation device that includes the improvements made in Invention Patent number 200802560/8 object of the invention. It basically comprises a characteristic supporting element that is fixed to the outer sides of skiing boots to receive and secure the rear sections of skis when the user is walking. The supporting element comprises in turn a movable part determined by a rotatable body and a fixed part determined by a ring base, on which the aforesaid movable part can rotate freely. At the same time, the latter incorporates a receptacle for receiving and securing the rear end sections of the skis.

Following the numbering adopted in the drawings, the ski transportation device with the improvements of the invention is determined on the basis of a supporting element 1 having a movable part determined by a rotatable body 2 and a fixed part determined by a ring base 3 that is fixed to the outer side of skiing boots 4 using a strap 5 that embraces the corresponding boot 4 in three different directions.

The rotatable body 2 incorporates a receptacle for holding the rear end section of the skis 6, said receptacle being delimited by a frontal elastic rim 7 and two adjustable runners 8 that can be adapted to the width of the skis 6.

The adjustable runners 8 comprise an angular configuration wherein the larger branches thereof are coupled to rails 9 in a dovetail, so that they adapt to the width of the skis 6, the latter butting at their edges against the smaller branches of said adjustable runners 8.

Stable securing of the adjustable runners 8 is achieved by means of bolts 10 that pass through longitudinal grooves 11 in said runners 8 and also through frontal holes 12 placed in a circular base 13 of the rotatable body 2, finally threading said bolts 10 to nuts 14 housed in notches in the circular base 13 of said rotatable body 2, in such a way that tightening the bolt 10 and the nut 14 ensures the stable position of the adjustable runners 8 adapted to the width of the respective ski 6. The longitudinal grooves 11 of the adjustable runners 8 are affected by beveling to adapt to the head of the bolts 10 and thereby prevent it from jutting outwards frontally to avoid collision with the skis 6 when being accommodated by their rear end sections into the rotatable body 2.

The elastic rim 7 starts from the edge of the circular base 13 of the rotatable body 2 delimiting an inner gap 15 where the end portion (tail) of the ski 6 is housed, at the same time as the elastic rim 7 has a bottom section 16 where the outer edge of the ski 6 rests. This inner gap 15 is delimited by the bottom section 16 and an enveloping intermediate section 16' which also forms part of the aforesaid elastic rim 7.

Meanwhile, the elastic rim 7 has a top arched section 17 close to the outer face of the circular base 13 of the rotatable body 2 in such a way that when the tail of the ski 6 is accommodated in the corresponding receptacle of the rotatable body 2, its insertion begins through a conical mouth 18 in the form of a funnel delimited between a curved end portion 19 forming part of the elastic rim 7 and a beveled portion 20 placed in a top zone of the circular base 13, in such a way that when the ski 6 is moved downwards, the rim 7 yields elastically allowing the ski 6 to penetrate until resting on the bottom section 16 of the aforesaid elastic rim 7 that will press frontally against the accommodated ski 6 improving securing thereof.

The circular base 13 of the rotatable body 2 incorporates on its rear face angular tabs 21 wherein their free portions engage by snap fitting into a circumferential slot 22 of the ring base 3, thereby ensuring the coupling between these two parts 2 and 3 of the supporting element 1, as well as the rotational mobility of the rotatable body 2.

On a separate note, the ring base 3 of the supporting element 1 incorporates three lateral openings 23 angularly equidistant from each other through which the three strands 5*a*-5*b*-5*c* of the fastening strap 5 of the supporting element 1 pass, in such a way that those three strands meet in the middle of the ring base 3, an intermediate disk 24 being inserted between the meeting point of said strands and the rotatable body 2, embedded in a housing of the annular ring 3 covering its central gap.

Fastening of the supporting element assembly 1 to the side of the boot 4 is ensured by means of the incorporation of a ring 25 of soft anti-slip material, such as neoprene foam, which is fixed to the ring base 3, whereupon this ring 25 will adjust to the irregularities and different profiles presented by the different ski boots 4 on this side resting zone.

Figure 6:
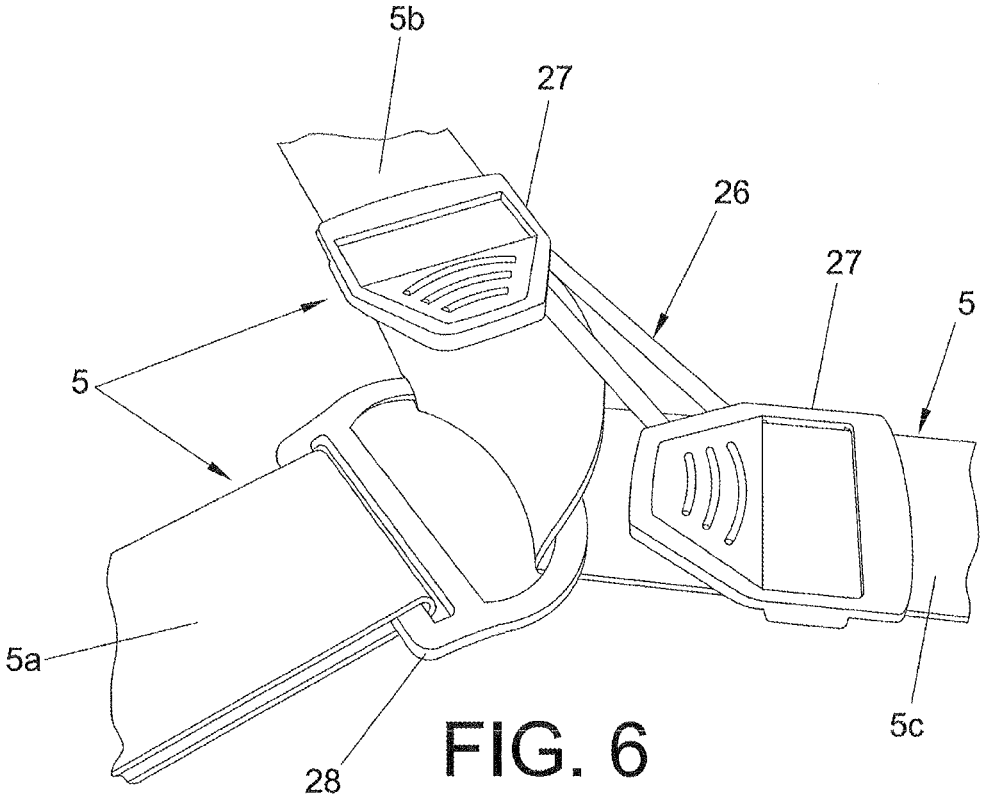
FIG. 6 is a view that essentially shows the three strands of a strap for fastening the supporting element to the skiing boot, said strands meeting in a central zone of the supporting element.

As shown in FIG. 6, in an embodiment to fasten the supporting element 1, the strap 5 follows a path that has the three strands 5*a*-5*b*-5*c* angularly equidistant from each other as mentioned previously, which meet in a central zone of the ring base 3 of the supporting element 1. One of the strands passes underneath the sole of the boot 4.

Figure 7:
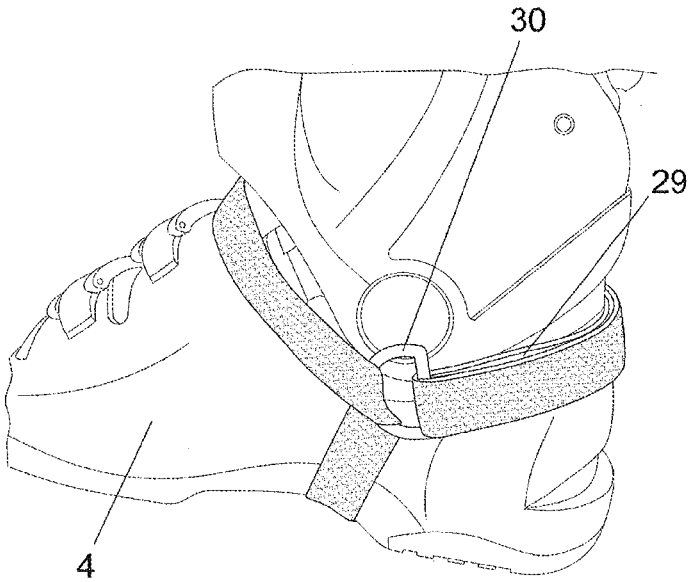
FIG. 7 is a view that essentially shows the fastening of the device of the invention to the corresponding boot.
Figure 8:
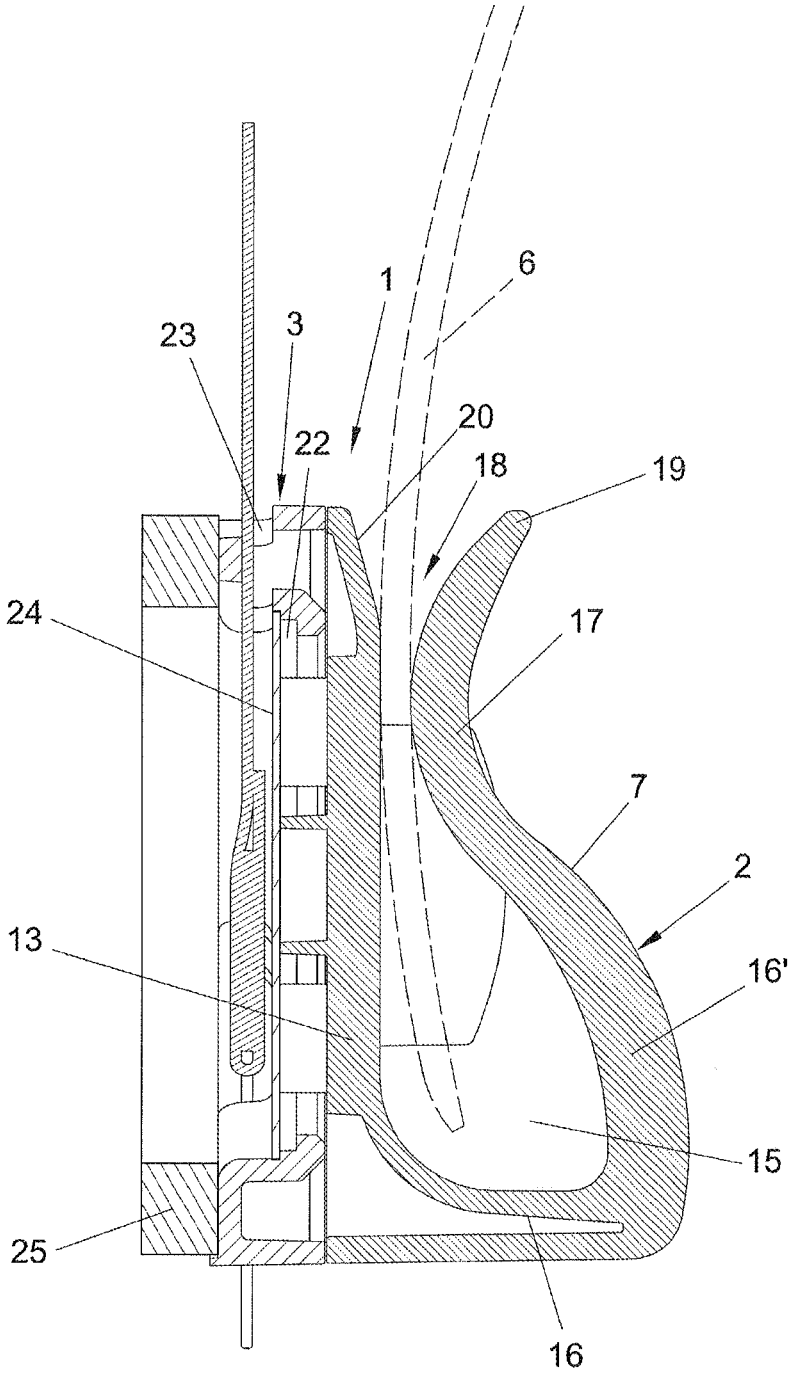
FIG. 8 shows a cross-section view of the assembly of the device with the improvements of the invention.

To this effect, a guiding piece 26 is incorporated with two end portions 27 at 120° through which two of the strands 5*b*-5*c* of the strap 5 pass, which meet in a central section that engages in a ring 28 which engages in turn the third strand 5*a* of the strap 5, which has an adherent surface 29 to ensure the fastening of the supporting element 1 to the boot 4 (FIG. 7) after making it pass through an outer ring 30 located on the inner side of the corresponding boot 4.

Figure 2:
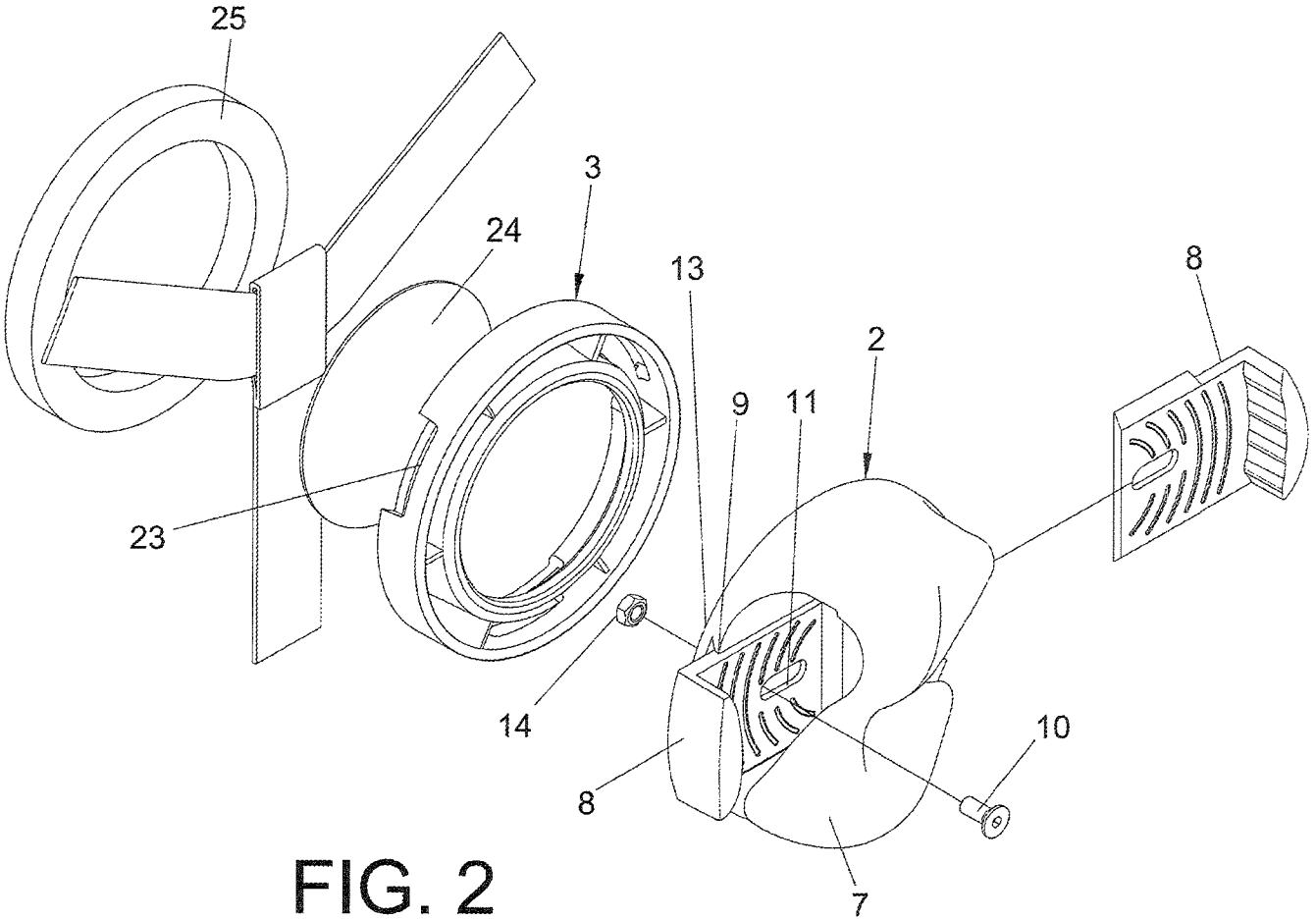
FIG. 2 shows an exploded view of the device with the improvements of the invention.
Figure 3:
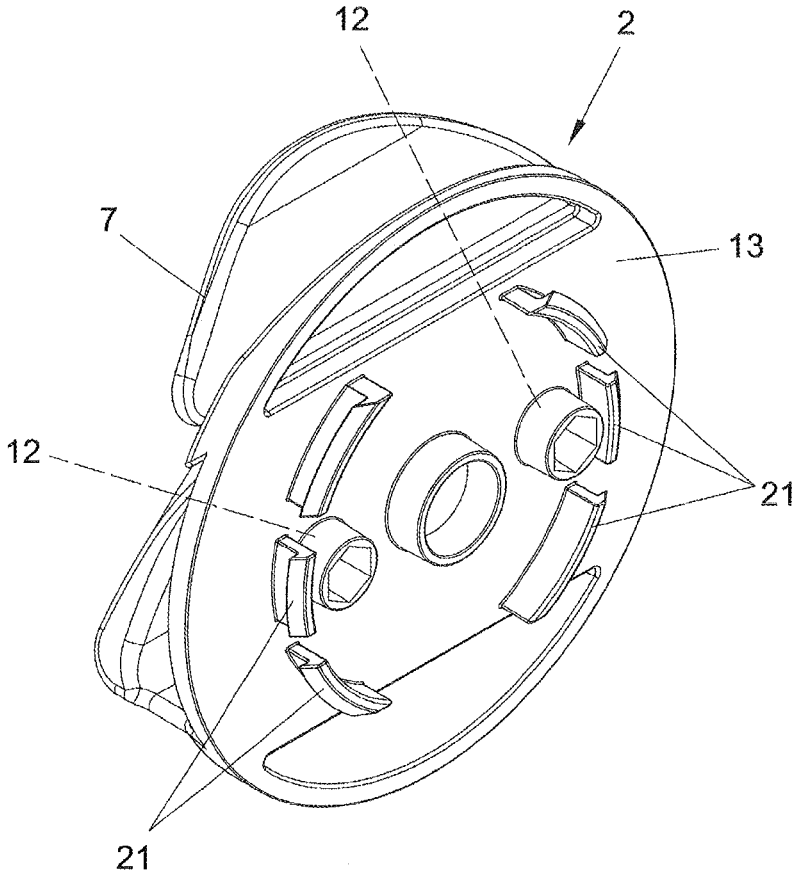
FIG. 3 shows a perspective view of the rotatable body forming part of the supporting element.
Figure 4:
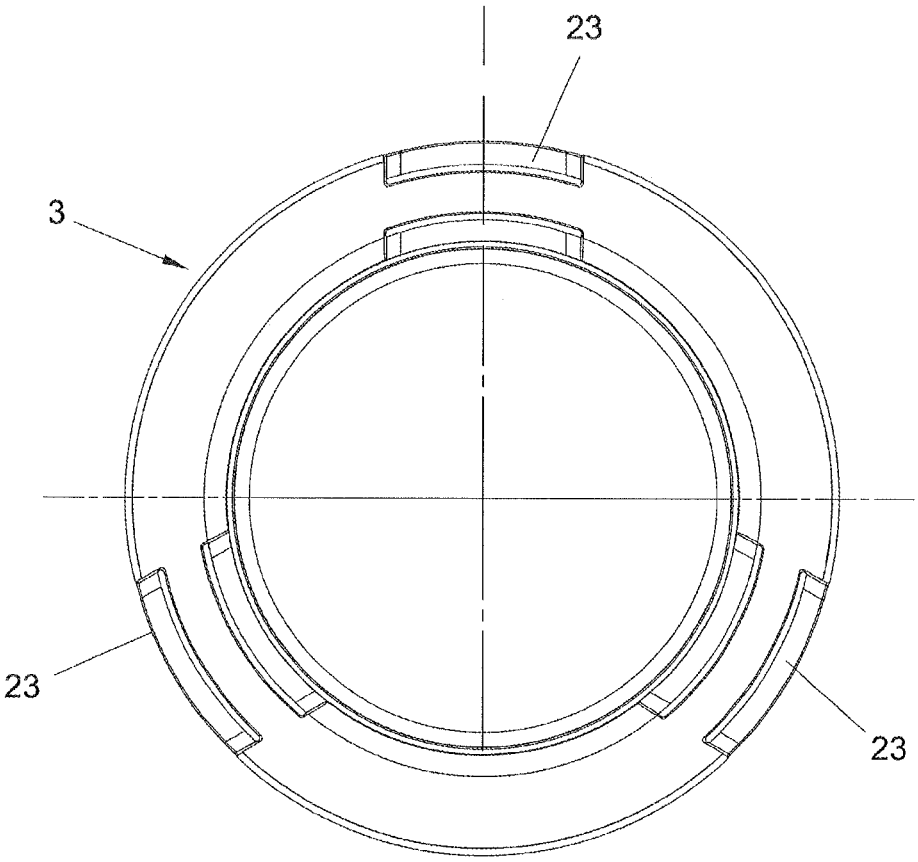
FIG. 4 shows a plan view of the ring base that forms part of the supporting element.
Figure 5:
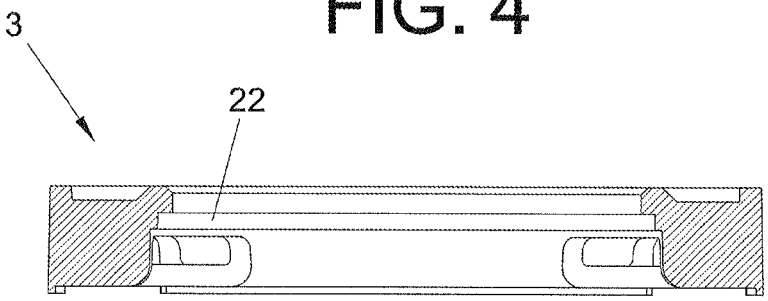
FIG. 5 shows a cross-section view of the ring base, along the A-A section of FIG. 4.

The meeting of the three strands 5*a*-5*b*-5*c* could present another different structure, such as the one shown in FIG. 2 which shows a meeting of two different straps.

The invention claimed is:

1. A ski transportation device, comprising:

a supporting element (1) for a ski configured to be fixed to an outer side of a ski boot (4), the supporting element (1) having a movable part formed by a rotatable body including a receptacle for receiving a rear end section of the ski and, a fixed part on which the movable part is coupled rotatingly;

wherein the receptacle is delimited by an elastic frontal retaining and support rim (7) for the ski and adjustable runners (8) adaptable to a width of the ski (6), wherein edges of the ski butt against a part of the adjustable runners (8) when the adjustable runners are stably adjusted to the width of the corresponding ski (6), and wherein the rotatable body (2) incorporates a circular base (13) from which the elastic rim (7) begins that is coupled to the adjustable runners.

2. The ski transportation device according to claim 1, wherein the fixed part of the supporting element (1) comprises a ring base (3) that includes a circumferential slot (22) coupled through snap-fitting to free branches of angular tabs (21) which start from a rear face of the circular base (13) of the rotatable body (2), and wherein relative mobility is achieved by said angular tabs (21) in combination with the circumferential slot (22) of the ring base (3).

3. The ski transportation device according to claim 2, further comprising an intermediate disk (24) embedded in a complementary housing of the ring base (3) of the rotatable body (2) as an element for closing a central gap that delimits a contour of said ring base (3).

4. The ski transportation device according to claim 3, wherein a supporting element (1) is fixed to the outer side of the ski boot (4) by at least one strap (5), which travels as determined by three strands (5*a*-5*b*-5*c*) in different directions that meet in the ring base (3) behind the intermediate disk (24), said strands passing through three side openings (23) placed in the ring base (3), ensuring closing by adherent surfaces (29) incorporated into the strap (5) in combination with an outer ring (30), at the same time as one of the strands passes underneath the sole of the ski boot (4).

5. The ski transportation device, according to claim 4, wherein where the three strands of the strap (5) meet a guiding piece (26) incorporated with two end portions (27) through which two of the strands (5*b*-5*c*) pass and meet in a central section that engages in a ring (28) where a third strand (5*a*) of the strap (5) engages in turn.

6. The ski transportation device according to claim 1, wherein the adjustable runners (8) are coupled on opposite rails (9) positioned in the circular base (13) of the rotatable body (2) and incorporate longitudinal openings (11) facing respective frontal holes (12), wherein the rotatable body (2) is placed in the circular base (13) and wherein bolts (10) are inserted through said longitudinal grooves (11) and frontal holes (12) bolts for stable securing of the position of the adjustable runners (8).

7. The ski transportation device according to claim 6, wherein the bolts (10) that secure the stable position of the adjustable runners (8) thread onto nuts (14) placed in bosses in the circular base (13) of the rotatable body (2).

8. The ski transportation device according to claim 6, wherein the longitudinal openings (11) incorporate bevelled edges to accommodate the head of the bolts (10) that secure the position of the adjustable runners (8) so that said head does not jut out in respect of the surface of the longitudinal openings (11).

9. The ski transportation device according to claim 6, wherein the adjustable runners (8) comprise an angular structure of unequal branches, wherein larger branches of the unequal branches incorporate the longitudinal openings (11) and are coupled to the opposite rails (9) of the rotatable body (2) and wherein smaller branches of the unequal branches delimit the width of the respective ski (6).

10. The ski transportation device according to claim 6, wherein the rails (9) of the rotatable body (2) comprise a dovetail-like structure.

11. The ski transportation device according to claim 1, wherein the elastic rim (7) comprises a bottom section (16) on which the end edge of the ski (6) is supported, defines a bottom gap (15) where the rear end portion is accommodated determined by the tail of the ski (6) and further comprises, a top arched section (17) close to an outer face of the circular base (13) of the rotatable body (2), wherein the bottom gap (15) is delimited by the bottom section (16) and an enveloping intermediate section (16') with a curved structure.

12. The ski transportation device according to claim 11, wherein a curved end portion (19) of the elastic rim (7) and a bevelled portion (20) of the circular base (13) of the rotatable body (2) delimit a conical mouth (18) in the form of a funnel where an introduction of the ski (6) begins by the rear end section of the respective ski inside the receptacle of the rotatable body (2) of a supporting element (1).

13. The ski transportation device according to claim 1, further comprising a ring (25) of soft anti-slip material that is inserted in a seating of the supporting element (1) against the outer side of the ski boot (4) enabling said supporting element (1) to operate as a separate assembly that can be fixed to the ski boot in a detachable manner.

* * * * *